US005851614A

United States Patent [19]

Buck

[11] Patent Number: 5,851,614

[45] Date of Patent: Dec. 22, 1998

[54] SELF-ADHESIVE OPAQUE DRY TRANSFER DECALS

[76] Inventor: Ronald Mark Buck, 423 Pacific, Solana Beach, Calif. 92075

[21] Appl. No.: 763,039

[22] Filed: Dec. 10, 1996

[51] Int. Cl.[6] ..... B41M 3/12

[52] U.S. Cl. ..... 428/40.1; 283/81; 428/40.9; 428/41.1; 428/41.3; 428/41.6; 428/41.7; 428/41.8; 428/42.1; 428/914

[58] Field of Search ..... 428/40.1, 40.9, 428/41.1, 41.3, 41.6, 41.7, 41.8, 42.1, 914; 283/81

[56] References Cited

U.S. PATENT DOCUMENTS

| | | | |
|---|---|---|---|
| 1,899,066 | 2/1933 | Tonge | 156/246 |
| 3,065,120 | 11/1962 | Avelar | 428/914 |
| 3,276,933 | 10/1966 | Brant | 428/914 |
| 3,432,376 | 3/1969 | Reed | 428/914 |
| 4,308,310 | 12/1981 | Arnold et al. | 428/195 |
| 4,421,816 | 12/1983 | Arnold | 428/202 |
| 4,633,276 | 12/1986 | Shibata et al. | 346/200 |
| 4,657,803 | 4/1987 | Pernicano | 428/200 |
| 4,721,635 | 1/1988 | Helinski | 428/15 |
| 5,227,233 | 7/1993 | Itaba et al. | 428/354 |
| 5,328,738 | 7/1994 | McKillip et al. | 428/40 |
| 5,389,415 | 2/1995 | Kaufmann | 428/40 |
| 5,466,502 | 11/1995 | Wilkinson et al. | 428/40 |
| 5,484,502 | 1/1996 | Bozanic | 156/235 |

*Primary Examiner*—Nasser Ahmad
*Attorney, Agent, or Firm*—Baker & Maxham

[57] ABSTRACT

A dry transfer decal is formed when a lithographic image is printed onto a transparent UV-dipped base sheet. Additionally, the decal includes opaque layers, a removable adhesive, and a release liner with a backing sheet. The lithographic decal provides an art-quality image, in a large format, which has vivid colors and precise graphic detail. The opaque background layers increase the brightness of the image colors and covers over any underlying logos when affixed to a display surface. The UV absorbing base layer reduces the strength of UV rays reaching the transfer image thus the decal resists fading even after prolonged exposure to sunlight. The base layer also prevents abrasion and scratching which is prone to occur in active environments.

11 Claims, 2 Drawing Sheets

SELF-ADHESIVE OPAQUE DRY TRANSFER DECALS

BACKGROUND OF THE INVENTION

1. Field of the Invention

The invention relates to printed transfers and, more particularly, to lithographic printed image dry transfers.

2. Description of the Related Art

Transfers are used to apply desired images or graphics to objects. The objects to which transfers are attached can be quite varied. Often, transfers are applied to relatively sturdy display surfaces such as vehicles, windows, equipment, and recreational goods. Many transfers are applied by manufacturers of goods to attach the manufacturer's logo or trademark to the goods. It is predicted, however, that increasingly transfers will be purchased as an aftermarket item to "customize" equipment by adding desired images. The most popular transfer images consist of simple graphics and commercial logos. Occasionally transfers are of sports celebrities and animation characters. Transfers that will be used for such applications should have certain desirable characteristics.

First, such transfers should be easy to apply. Wet transfer decals have been used for many years and comprise images printed on a substrate film that is attached to a backing sheet. The wet transfer decal must be soaked in water or a special release solution to separate the image-containing substrate film from the backing sheet. The substrate film can be slid from the backing sheet into the desired position on a display surface and then allowed to dry. Application of wet transfer decals therefore can take place only when and where a release solution is available, which then must be disposed of properly. Wet transfer decals are for dry environments only. If used in a wet environment such as a sports application the adhesive may become liquified, thus losing its adhesive properties.

Dry transfer decals are comprised of images that are deposited on an adhesive-coated base sheet. Additionally, there is a release layer and backing sheet that serve to protect the adhesive coating. When the backing sheet is removed, the adhesive is exposed and the image-containing base sheet can be attached to the desired display surface. The backing layer is then discarded. Hence, a dry transfer decal eliminates the need for a release solution. Dry transfer is more convenient than wet transfer and is generally preferred.

Typically, a dry transfer image is formed when one or more ink layers is deposited on the base sheet, which is also called a support layer. Next, there is a backing sheet that usually includes a release layer that facilitates removal of the image-containing base sheet from the backing sheet. The backing sheet protects the adhesive from dirt and deterioration, thus the dry transfer is easier to transport and store. The release layer and backing sheet are not removed until the dry transfer decal image is to be applied to a display surface, whereupon the adhesive layer is exposed and the dry transfer is placed on the display surface in the desired location. Thus, the dry transfer is easily affixed.

Dry transfer decals are described, for example, in U.S. Pat. No. 4,421,816 to Arnold and U.S. Pat. No. 4,308,310 to Arnold et al.

Visual quality of the transfer image is important. Silk screen techniques force ink or paint colors through mesh screens onto a base sheet, depositing thick layers that can provide vivid colors but which require substantial drying time for each color layer. Additionally, the silk screen process is labor intensive for creating the screens for each different color and for adding the color layers, one on top of the others, to the base sheet. Thus, silk screen techniques are relatively expensive and generally are not feasible except for great numbers of small images on large master sheets. For example, a practical single silk screen image size might be on the order of a few inches square.

Dry transfers described in the above-referenced U.S. Pat. No. 4,421,816 to Arnold were created with silk screen techniques using mesh screens of 100 threads per inch and 140 threads per inch.

Printed images, as opposed to silk screening, can be created quickly on base sheets in large quantities, making printed images a commercially viable method of producing transfers. Printed images are resolved from individual picture elements of color, or dots. For example, a three-color additive print process uses red, blue, and green inks to create the perception of many more colors, depending on the size and numbers of dots of each color. A four-color additive process typically uses red, blue, green, and black ink. Typical printing techniques for labels can quickly and reliably produce images the size of a standard paper (8½ inch×11 inch, or A4 or similar size) page.

Printed labels used for packaging containers such as bottles are described in U.S. Pat. No. 5,227,233 to Itaba et al. (four-color gravure printing). A combination of ink and paint layers on self-adhesive labels is described in U.S. Pat. No. 1,899,066 to Tonge.

When offset lithographic printing processes are used, the visual quality of a printed image is often greater than that possible with silk screening techniques. Silk screen and lithographic printing resolution are referenced in screen lines, or threads, per inch. A typical resolution that can be achieved by silk screen processing is on the order of 100 screen lines per inch. In contrast, offset lithographic printing can achieve on the order of 300 screen lines per inch.

Typical computer-printed output, such as ink jet or laser print machines, measure their output in dots per inch (dpi). Computer-printed output is based on a pixel (dpi) specification, while silk screen and offset press resolution is based on a raster image specification. A typical ink jet printer can achieve resolution of approximately 300 dpi. For comparison, offset lithographic printing of 300 screen lines per inch is roughly equivalent to 3000–3600 dpi. Thus, offset printing provides the highest quality printing image.

In addition to visual quality, however, it is also important for a transfer to have durability. Many decals are used in applications where they are exposed to physical contact and to direct sunlight. Physical contact can cause abrasion and scratching of the decal image. The ultraviolet (UV) rays of sunlight can cause deterioration of the transfer in general and fading of the decal image in particular. To maintain an attractive appearance after the affects of abrasion and sunlight, the decal must be removed from the display surface.

Removing a decal can be problematic, because most often it is scraped off with a sharp-edged tool that may or may not damage the display surface. Furthermore, when a decal is peeled off it leaves behind a sticky, dirt-attracting residue that must then be removed with a toxic chemical such as paint thinner or acetone.

From the discussion above, it should be apparent that there is a need for an economically produced dry transfer decal that comes in a large format and is easy to apply and reposition, and provides a good image quality that is durable and resists fading. The present invention satisfies this need.

SUMMARY OF THE INVENTION

The present invention provides a dry transfer decal having a lithographic image that is printed onto a UV-absorbing base sheet, an opaque background often consisting of two layers, and a film of removable adhesive, which is protected by a backing sheet that is lined with a release layer or coating adjacent to the adhesive. Dry transfer decals are much easier to apply than wet transfer decals. Lithographic printing techniques provide an image quality comparable to that of commercial artwork, with bright, vivid colors, large image size, and precise graphic detail. Opaque background layers increase the brightness of the image colors and cover over any underlying logos when affixed to a display surface. The UV-absorbing layer reduces the strength of UV rays reaching the transfer image; thus, the decal resists fading even after prolonged exposure to sunlight.

In one aspect of the invention, the decal image is reverse printed on the backside of a transparent base sheet. The transparent base places a durable layer in front of the image and the reverse printing properly orients the produced image. In this way, the image is viewed from behind the base sheet and is protected from abrasion and other physical contact. In another alternative form of the invention, the decal image is printed onto a self-adhesive sheet and covered with a transparent protective cover sheet.

Other features and advantages of the present invention should be apparent from the following description of the preferred embodiments, which illustrate, by way of example, the principles of the invention.

DESCRIPTION OF THE PREFERRED EMBODIMENTS

Figure 1:
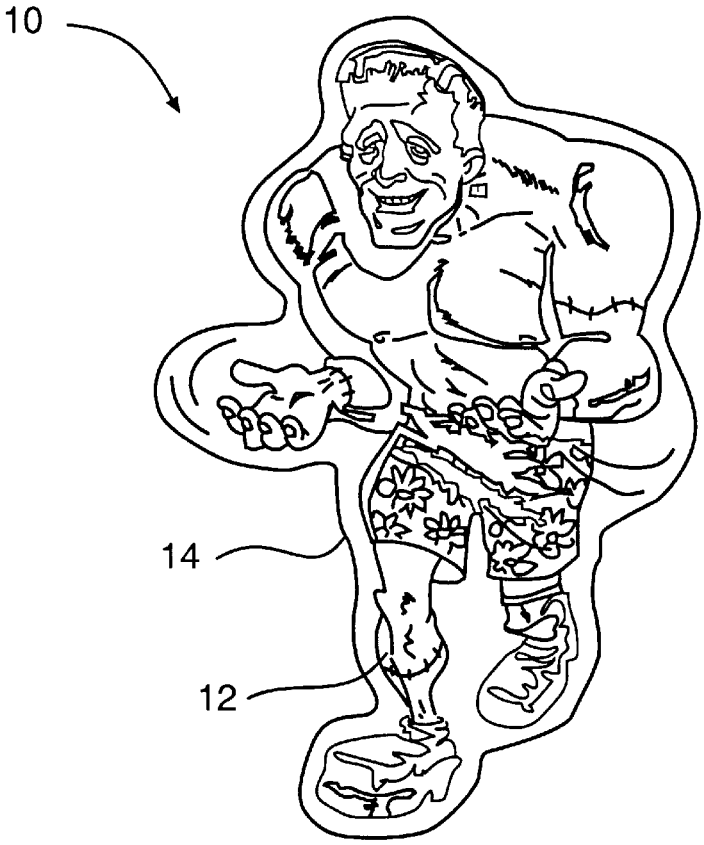
FIG. 1 is an isometric view of a dry transfer decal produced in accordance with the invention.
Figure 2:
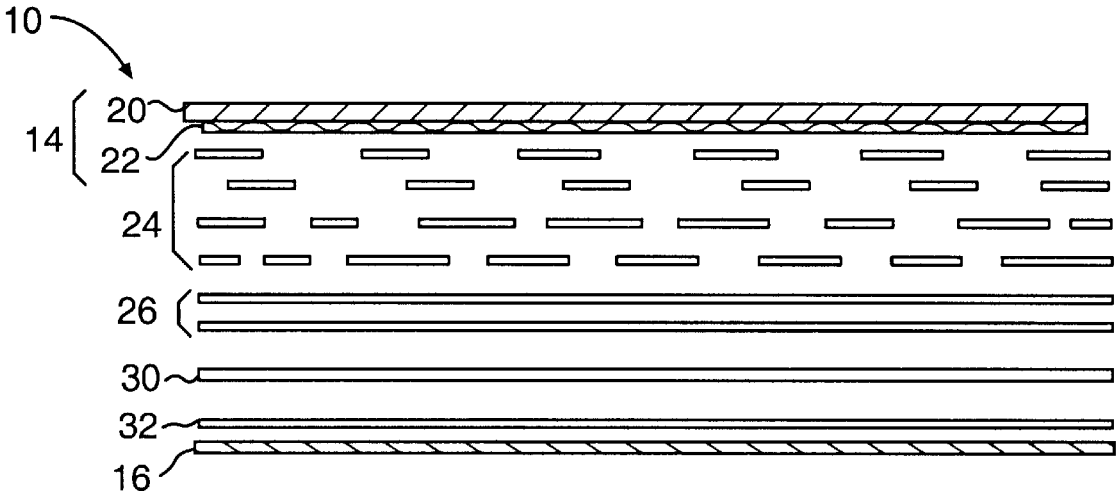
FIG. 2 is a sectional view of the FIG. 1 dry transfer decal.
Figure 3:
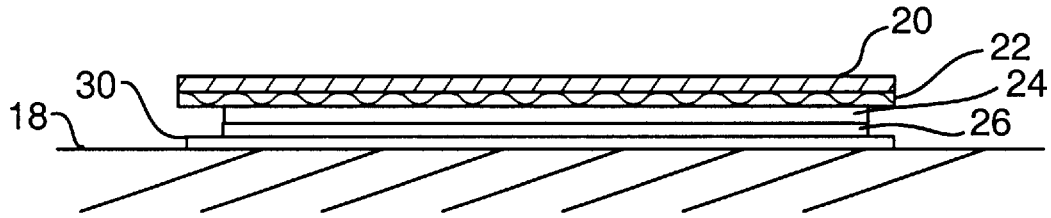
FIG. 3 is a sectional view of the FIG. 1 dry transfer decal after it has been affixed to a display surface.

FIG. 1 shows a self-adhesive dry transfer decal 10 produced in accordance with the invention. The decal 10 comprises an image 12 that is printed onto a base sheet 14 with ultraviolet (UV) absorbing properties, using lithographic printing techniques. FIG. 2 shows the decal 10 in cross section, with a removable backing sheet 16 attached. The cross section of FIG. 3 shows the backing sheet removed and the decal affixed to a display surface 18. The lithographic printing techniques permit the decal 10 to be economically produced and easily applied to the display surface, with a large, art-quality image that is durable and resists fading.

The cross-section of FIG. 2 shows the layers of the decal 10 spaced apart for purposes of illustration (not to scale). The base sheet 14 comprises a transparent film 20, such as "MYLAR"υ film from the E. I. DuPont de Numours Company, which is impregnated with a UV-absorbing solution 22 that can be applied via a UV dip process known to those skilled in the art. A UV-dipped, 2 mil to 4 mil thick "MYLAR" film is available, for example, from Cortalds Performance Films Company. Such film reduces the strength of UV rays penetrating the transparent film by 97%, thereby resisting fading of underlying inks from exposure to direct sunlight and other radiation, such as fluorescent lighting.

FIG. 2 shows multiple ink layers 24 deposited on the base sheet 14. In particular, six ink layers (including the opaque layers) are indicated in FIG. 2 to emphasize that the lithographic printing process used to create the decal image 12 (FIG. 1) is a six-color process of commercial art quality. Those skilled in the art will appreciate that commercial art quality lithographic printing is typically performed using offset press printing techniques and is generally faster and of better quality than other automated, high-speed printing techniques such as laser printers and ink jet printers.

Current laser and ink jet printing techniques can provide a resolution of approximately 600 to 1000 dots per inch (dpi) at a speed of approximately ten to twelve paper sheets per minute. In contrast, current lithographic techniques that achieve 150 screen lines per inch provide resolution at the equivalent of thousands of dpi at printing speeds of 14,000 paper sheets per hour, or approximately 8,000 "MYLAR" sheets per hour. The greater resolution possible with lithographic printing provides images with quality sufficient for prints and posters typically sold in commercial art galleries. In the preferred embodiment, offset lithographic printing techniques are used that provide 150 to 300 screen lines per inch.

Those skilled in the art of offset printing will recognize that, because the base sheet 14 is transparent, the ink layers 24 must be deposited in a "reverse-image" process so they will appear correct when viewed through the base sheet. In addition, those skilled in the art will recognize that lithographic printing techniques can provide large-format images that meet the standards of commercial artists but cannot be obtained with current laser and ink jet printing. For example, the decal 10 can easily be produced with an image size of 40 inches. This means increased decal visibility from distances up to 50 yards.

Printing the ink layers 24 on the underside of the base sheet 14 further protects the ink layers from deterioration. If the ink layers were simply deposited onto the top surface of the base sheet, the ink layers would be extremely susceptible to scratching and abrasion. In this regard, the base sheet 14 protects the ink layers from abrasion. If desired, the transparent film 20 can be selected for enhanced scratch resistant protection of the ink layers, generally by selection of increased thickness.

After the ink layers 24 are printed, one or more opaque layers 26 are deposited exactly behind the ink layers, as shown in FIG. 2. The opaque layers 26 can comprise, for example, a white ink or white ink-compatible paint. Making the opaque layer white provides a uniform background for the ink layers when the decal 10 is affixed to the display surface 18 and generally increases the vividness of the ink layers. Alternatively, the opaque layer may include silver or metallic ink. Metallic inks are the most opaque currently available and as such are valued for their non-transparent properties. The color of the opaque layer will be selected in accordance with the inks used and the colors of the image 12. The opaque layers may also cover underlying display surface irregularities.

The opaque layers 26 cover images or logos associated with the display surface. For example, the display surface might comprise an item of recreational equipment, such as a surfboard or boat. It might be desired to place the decal 10 directly over an area of the recreational equipment that is affixed with the trademark or logo of the equipment manufacturer.

Adjacent to the opaque layer 26 is applied an adhesive layer 30. The adhesive layer preferably is of a high-tack formulation that securely bonds the decal 10 to the display surface 18, but permits careful, deliberate release of the decal for repositioning or removal. Furthermore, the removable adhesive shall preferably stay on the decal rather than depositing on the display surface. Thus, no sticky residue is left behind to attract unwanted dirt and grime.

The backing sheet 16 is coated with a release layer 32, such as wax or plastic, before being placed in contact with the adhesive layer 30. The release layer ensures that the backing sheet can be easily removed to permit applying the decal 10 to the display surface 18.

FIG. 1 shows that the base sheet 14 preferably is cut to substantially follow the contours of the image 12. In particular, the ink layers 18 (FIGS. 2 and 3) are deposited and the transparent base sheet is die-cut so that approximately ¼ inch of the base sheet remains substantially along the entire image border. That is, there is approximately ¼ inch of the transparent base sheet 14 extending from the outer edge of the decal image. The advantage of such a clear border as opposed to a white border, for example, is that the decal takes on the color of the display surface. That is, the decal appears to blend with or become a part of the display vehicle. The quarter-inch clear border permits easier handling of the decal during positioning and application. Once affixed to the display surface 18, the clear border helps resist peeling and curling of the decal 10 from the display surface. The clear border also permits maximum image size by including small adjacent "floating" images. Finally, the clear border minimizes the area of the display surface that will be covered by the decal. The latter feature is important in providing the appearance of the image 12 being directly applied to the display surface.

Figure 4:
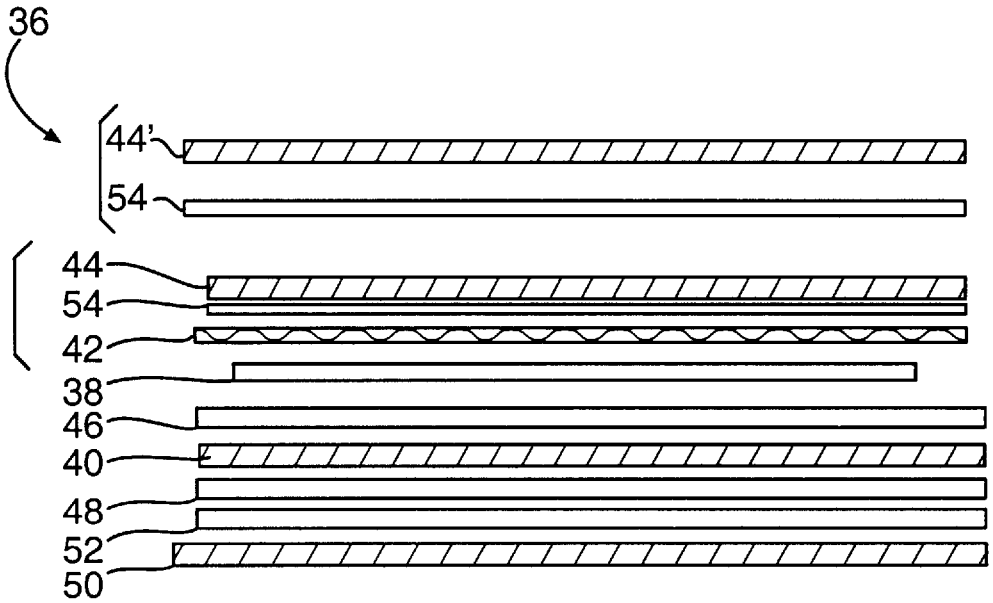
FIG. 4 is a sectional view of an alternative embodiment of a dry transfer decal produced in accordance with the invention.

FIG. 4 shows an alternative embodiment 36 of the invention wherein the decal image 12 (FIG. 1) is formed from opaque layers 46 and multiple ink layers 38 deposited directly on top of a base sheet 40. A UV-absorbing layer 42 is deposited over the ink layers and is then covered by a cover sheet 44. The cover sheet 44 is attached to the UV-absorbing layer 42 by an adhesive layer 54. Alternatively, the UV layer can be a part of the cover sheet, forming an impregnated cover sheet 44' and then the adhesive layer 54 is required for attachment of the sheet 44' to the ink layers 38. Opaque layers 46 are deposited between the base sheet and the ink layers 38. It should be appreciated that the FIG. 4 embodiment does not require reverse printing onto the base sheet, should that be desired. The cover sheet 44 provides the protection from UV deterioration and abrasion that otherwise is supplied from the base sheet itself (see FIGS. 2–3). Likewise, the composition and thickness of the cover sheet can be selected to provide enhanced scratch resistance and UV protection for the ink layers. An adhesive layer 48 is covered by a backing sheet 50 and an intervening release layer 52.

Thus, the present invention provides a dry transfer decal having a lithographic image that is printed onto an opaque background on a self-adhesive base sheet having an ultraviolet (UV) protective cover sheet. Lithographic printing techniques provide bright, vivid colors, large image size, and precise graphic detail, providing superior image quality. The opaque background layer of both embodiments increases the brightness of the image colors and covers over any underlying logos when affixed to a display surface. The UV absorbing layer reduces the strength of UV rays reaching the transfer image thus the decal will resist fading even after prolonged exposure to sunlight.

The present invention has been described above in terms of a presently preferred embodiment so that an understanding of the present invention can be conveyed. There are, however, many configurations for dry transfer decals not specifically described herein but with which the present invention is applicable. The present invention should therefore not be seen as limited to the particular embodiment described herein, but rather, it should be understood that the present invention has wide applicability with respect to dry transfer decals generally. All modifications, variations, or equivalent arrangements that are within the scope of the attached claims should therefore be considered within the scope of the invention.

I claim:

1. A dry transfer decal for affixing to a display surface, the decal comprising:

a transparent base sheet having ultraviolet absorbing properties;

a decal image comprising multiple ink layers printed onto the transparent base sheet using offset printing techniques;

an opaque layer laid on top of the decal image ink layers;

a releasable adhesive layer laid on top of the opaque layer; and a backing sheet, having a release layer, that when removed exposes the releasable adhesive, thereby permitting the transparent base sheet and ink layers to be attached to the display surface.

2. A dry transfer decal as defined in claim 1, wherein the base sheet provides a scratch resistant protective layer for the decal image ink layers.

3. A dry transfer decal as defined in claim 1, wherein the decal image is produced with lithographic printing techniques to a resolution of at least 150 screen lines per inch.

4. A dry transfer decal as defined in claim 1, wherein the transparent base sheet is die-cut around the decal image to provide an approximate one-fourth inch transparent base sheet border extending around the outer edge of the decal image.

5. A dry transfer decal as defined in claim 1, wherein the decal image is produced with reverse-printing onto the base sheet.

6. A dry transfer decal for affixing to a display surface, the decal comprising:

a transparent base sheet having a top surface and a back side, the base sheet having one or more opaque layers applied to the top surface of the base sheet;

a decal image comprising multiple ink layers printed on top of the opaque layers using offset printing techniques;

a releasable adhesive laid on the backside of the base sheet;

a transparent cover sheet, having ultraviolet (UV) absorbing properties;

an adhesive layer that attaches the transparent UV cover sheet to the decal image ink layers; and a backing sheet, having a release layer, such that when the backing sheet is removed the releasable adhesive is exposed, thereby permitting attachment of the base sheet, ink layers, and cover sheet to the display surface.

7. A dry transfer decal as defined in claim 6, wherein the cover sheet provides a scratch resistant protective layer that protects the ink layers from abrasion.

8. A dry transfer decal as defined in claim 6, wherein the decal image is produced with lithographic printing techniques to a resolution of at least 150 screen lines per inch.

9. A dry transfer decal as defined in claim 6, wherein the base sheet is die-cut around the decal image to provide an approximately one-fourth inch transparent base sheet border extending around the outer edge of the decal image.

10. A dry transfer decal as defined in claim 6, wherein the ink layers and the releasable adhesive are on opposite sides of the transparent base sheet.

11. A dry transfer decal as defined in claim 6, wherein the ink layers and the releasable adhesive are on the same side of the transparent base sheet.

* * * * *